US007401777B2

(12) United States Patent
Jentzsch

(10) Patent No.: US 7,401,777 B2
(45) Date of Patent: Jul. 22, 2008

(54) APPARATUS FOR SUPPLYING A SHINGLED OR OVERLAPPING SHEET STREAM

(75) Inventor: Arndt Jentzsch, Coswig (DE)

(73) Assignee: Koenig & Bauer AG (DE)

( * ) Notice: Subject to any disclaimer, the term of this patent is extended or adjusted under 35 U.S.C. 154(b) by 404 days.

(21) Appl. No.: 11/083,910

(22) Filed: Mar. 18, 2005

(65) Prior Publication Data

US 2005/0230905 A1 Oct. 20, 2005

(30) Foreign Application Priority Data

Mar. 30, 2004 (DE) ..... 10 2004 015 335

(51) Int. Cl.
*B65H 9/04* (2006.01)

(52) U.S. Cl. ..... 271/245; 271/276; 271/262; 271/196; 271/197

(58) Field of Classification Search ..... 271/245, 271/246, 276, 262, 263, 196, 197
See application file for complete search history.

(56) References Cited

U.S. PATENT DOCUMENTS 3,826,487 A * 7/1974 Forster et al. ..... 271/263
4,651,984 A 3/1987 Emrich
5,288,067 A 2/1994 Stock
5,626,077 A * 5/1997 Muller ..... 101/484
6,672,587 B1 * 1/2004 Mohringer et al. ..... 271/259

FOREIGN PATENT DOCUMENTS

| | | | |
|---|---|---|---|
| DE | 33 31 662 | A1 | 3/1985 |
| DE | 44 42 629 | A1 | 6/1995 |
| DE | 44 16 286 | A1 | 11/1995 |
| DE | 44 42 629 | | 6/1996 |
| DE | 196 18 870 | A1 | 11/1997 |
| DE | 198 17 175 | A1 | 3/1999 |
| EP | 0 554 774 | | 8/1993 |
| EP | 1155996 | | 11/2001 |

* cited by examiner

*Primary Examiner*—David H Bollinger
(74) *Attorney, Agent, or Firm*—Goodwin Procter LLP

(57) ABSTRACT

The invention relates to a device for supplying a shingled or overlapping sheet stream from a stack of sheets of a sheet feeder to a feed table of a sheet-processing machine with a belt table. The belt table is provided with at least one revolvingly driven suction belt, which is in operative connection with at least two suction boxes that can be acted upon by negative pressure. The invention can include a device for taking hold of the sheets. The invention also relates to altering a device so that, independently of the material to be processed, a last sheet of a sheet stream can be easily aligned. This objective is accomplished as follows: after the last sheet is detected and its front edge has been placed against the front guide stops, the operation of the suction belt is stopped.

14 Claims, 1 Drawing Sheet

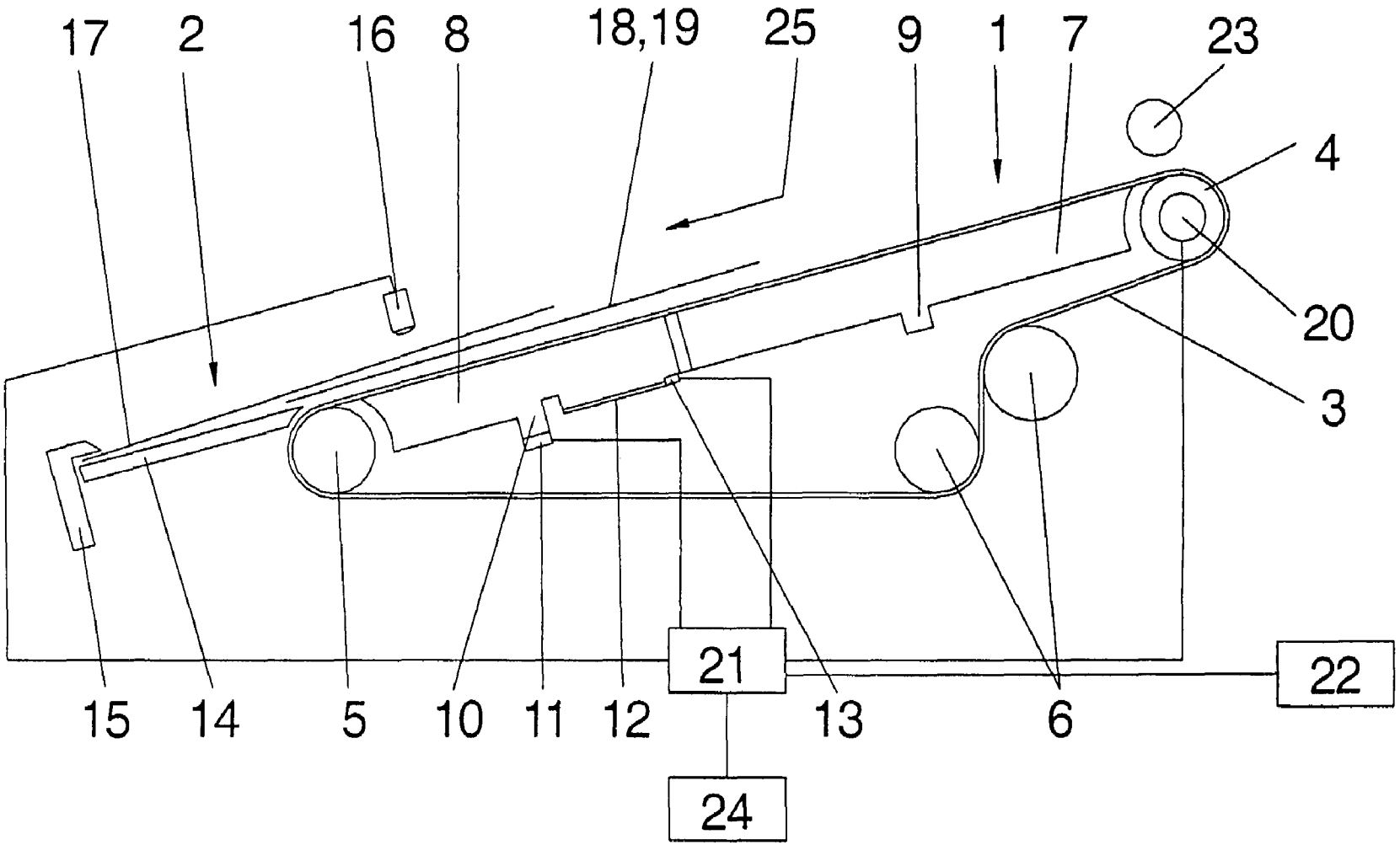
23
4
20
3
22
7
1
9
25
18,19
8
16
2
17
6
13
21
24
12
11
10
5
14
15

APPARATUS FOR SUPPLYING A SHINGLED OR OVERLAPPING SHEET STREAM

BACKGROUND OF THE INVENTION

The invention relates to an apparatus for supplying a shingled or overlapping sheet stream from a stack of sheets of a sheet feeder to a feed table of a sheet-processing machine.

Such devices are generally known. The sheets, segregated from a stack of sheets by a sheet feeder, are transported as a shingled or overlapping sheet stream on a belt table having suction belts, are taken hold of there by the suction belts and are transported to the feed table. At the same time, in the region where the sheets are taken over, the suction belts are acted upon with a negative pressure by a suction chamber facing the sheet feeder. At the same time, in the region of sheet transfer on the feed table, the suction belts are acted upon with negative pressure by a suction chamber facing the machine. The front sheet of the sheet stream is guided on the feed table with the front edge against front guide stop and thus is aligned with the font edge. Subsequently, the sheet is aligned, for example, with the side edge. During the alignment of the front sheet, the latter must be guided by the suction belt by a holding force, so that the front edge is not damaged while the sheet is fed to the front guide stop and thus lateral alignment is possible without problems. This becomes feasible owing the fact that, due to the under-shingled subsequent sheet, the suction belts are covered completely or almost completely, so that the sheet, which is to be aligned, is guided only with a slight holding force in the transfer region. If there is no subsequent sheet, for example, when the sheet stream is interrupted, the holding force acting on the last sheet to be aligned, during the processing of paper, presents a potential danger of damage to the front end of the sheet and an accurate lateral alignment is not possible.

In order to eliminate this disadvantage, it is proposed in EP 0 554 774 B1 that the supplying of the last sheet of the sheet stream be detected. When the final sheet in the stream reaches the alignment end, the supply of negative pressure to the suction chamber facing the machine is interrupted and this suction chamber is connected with a source of positive pressure. This device cannot be used for thin printing paper, since there is no defined guiding of the last sheet to the front guide stop.

SUMMARY OF THE INVENTION

It is an object of the invention to change a generic device so that, independently of the material that is to be processed, the last sheet of a sheet stream can also be aligned without problems.

Pursuant to the invention, this objective is accomplished by an apparatus for supplying a shingled or overlapping sheet stream from a stack of sheets of a sheet feeder to a feed table of a sheet-processing machine with a belt table, which is provided with at least one revolvingly driven suction belt, which is in operative connection with at least two suction chambers, which can be acted upon by negative pressure, as well as means for tag hold of the sheets, characterized in that, after a last sheet of the sheet stream is detected and the font edge of the last sheet has been placed against the front guide stop or stops, the operation of the suction belt can be stopped.

The inventive solution enables the last sheet of a shingled sheet stream to be placed against the front guide stop or stops independently of the nature of the material. Thus, it is ensured that the entirety of the material reaching the processing stage is processed defect-free.

BRIEF DESCRIPTION OF THE DRAWING

The FIGURE illustrates the apparatus according to the present invention.

DETAILED DESCRIPTION OF THE INVENTION

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

The invention is explained in greater derail by means of an example. In the associated drawing, a belt table 1 with a downstream feed table 2 is shown diagrammatically in side view. The belt table 1 has at least one suction belt 3, which is guided over an upper guide roller 4 and a lower guide roller 5 and tensioned by means of two rollers 6. An upper suction chamber 7 facing a sheet feeder, which is not shown, and a lower suction chamber 8, facing a sheet-processing machine, which is also not shown, are disposed in the belt table 1. Further suction chambers may be disposed between suction chambers 7, 8. The upper suction chamber 7 is connected over a suction connecting piece 9 with a first source of negative pressure, which is not shown and the lower suction chamber 8 is connected over a suction connecting piece 10 with a second source of negative pressure, which is not shown. A servo unit 11, which opens or closes the suction connecting piece 10, is disposed at the suction connecting piece 10. Furthermore, an air-removing flap 12, which can be actuated by means of a servo device 13, is disposed at the lower suction chamber 8.

The feed table 2, of which a table sheet 14 is shown, is downstream from the belt table 1. A front guide stop 15 is shown in a position at the feeder table 2. The front guide stop 15 can be brought in a working cycle from a position at the feed table 2 into a position swiveled away from the feed table 2. A sheet 17, which is to be aligned and which is followed by a sheet 18 as the last sheet 19, is shown lying in contact with the front guide stop 15. Furthermore, a double-sheet control 16 is provided ahead of the lower guide roller 5 and a sponging roller, operating at a time cycle, is assigned to the upper guide roller 4. The suction belt 3 is driven in a sheet-transporting direction 25 by a driving unit 20, which is assigned to the upper guide roller 5. The driving unit 20 is connected with a control unit 21, which is linked with the servo unit 11, the servo device 13 and the double-sheet control 16. The machine control 22 and an input unit 24 are also connected with the controlled unit 21.

The sheets, segregated by the sheet feeder, are supplied shingled to the belt table 1 and, supported by the sponging roller 23 guided in the working cycle against the upper guide roller 4, taken hold of by the suction belt 3. The holding force, acting on the sheets, is realized by the negative pressure, which is built up in the upper suction chamber 7 by means of the source of negative pressure connected with the suction connecting piece 9. The sheets are conveyed in the sheet-transporting direction 25 as a sheet stream by the suction belt 3, driven by the driving unit 20, the front sheet of the sheet stream being transported as a sheet 17, which is to be aligned on the feed table 2 and with tie front edge against the front guide stop 15. At the same time, the holding force, acting on the sheet 17 to be aligned and generated from the negative pressure existing in the lower suction chamber 8, is minimized or eliminated completely by the underlapping of the following sheet 18. Thus, the sheet 17, which is to be aligned, can be placed without problems against the front guide stop 15 and, subsequently, likewise optionally aligned at the side edges. After it is aligned, the sheet 17 is pulled off by means not shown and transported downstream to the next sheet-processing machine. Simultaneously with the pulling off of the sheet 17 that is to be aligned, the next sheet 18 is conveyed in the sheet-transporting direction 25.

Depending on the position on the belt table 1 as well as the staggered distances of the underlapped sheet stream, if a single sheet is detected instead of a double or triple sheet, the single sheet is recognized as the last sheet of the sheet stream and a signal is generated. Preferably, the double-sheet control 16 is assigned to the belt table 1 in such a manner that it takes hold of the sheet 17/subsequent sheet 18 and/or a further sheet, to align the underlapping sheet(s).

The signal, generated by the double-sheet control 16, is supplied to the control unit 21. Thus, the last sheet 19 is recognized and the number of sheets between the front guide stop 15 and the last sheet 19, or the number of operating cycles which must be realized before the last sheet 19 lies against the font guide stop 15 as a sheet 17 to be aligned, is determined. If the sheet, referred to as the subsequent sheet 18 in the pictorial representation, is determined to be the last sheet 19, the subsequent sheet 18/last sheet 19 is transported against the front guide stop 15 by means of a sheet-supplying device, which is not shown, while the sheet 17 to be aligned, is pulled off. At the same tie, controlled by the control unit 21, the drive unit 20 is stopped and, thus, the movement of the suction belt 3 is interrupted when the front edge of the subsequent sheet 18, determined to be the last sheet 19, is up against the front guide stop 15. Moreover, the drive unit 20 can be stopped so that the last sheet 19 is up against the front guide stop with a slight excess pressure. Simultaneously as or immediately before the sheet 19 comes up against the front guide stop 15 or within an operating cycle, in which the last sheet 19 is transported, the supply of negative pressure to the lower suction chamber 8 by means of the servo unit 11 is interrupted by way of the control unit 21 and the air-removing flap 12 is opened by the servo device 13. Thus, the last sheet 19 can be aligned with the side edge and, subsequently, pulled off.

The interruption of the supply of negative pressure to the lower suction chamber 8 by means of the servo unit 11 and the opening of the air-removing flap 12 by the servo device 13 can be controlled by the input Unit 24 within the working cycle, in which the last sheet 19 is transported to the front guide stop 15. With that, the release of the last sheet 19 can be adapted to the material to be processed or to the configuration of the sheet installation. For example, in the case of a sheet installation, wherein after the alignment with respect to the front edge, a side edge alignment is provided on the feed table 2, the lower suction chamber 8 must be ventilated earlier than in the case of a sheet installation with the side edge alignment on a downstream cylinder.

In the example, it is described that the last sheet 19 as well as its position on the belt table is detected by the double-sheet control 16. It is also possible to detect the last sheet 19 by additional means. Moreover, the last sheet 19 and additionally the sheets on the feed table 1/belt table 2 before the last sheet 19, can be detected by the machine control system.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

The invention claimed is:

1. An apparatus for supplying a shingled or overlapping sheet stream from a stack of sheets of a sheet feeder to a feed table of a sheet-processing machine with a belt table, which is provided with at least one revolvingly driven suction belt in operative connection with at least two suction chambers, which can be acted upon by a supply of negative pressure, said apparatus including a front guide stop and a device for detecting a last sheet in the sheet stream, wherein the at least one revolvingly driven suction belt is adapted to stop operating after the last sheet of the sheet stream is detected by the device for detecting and the front edge of the last sheet has been placed against the front guide stop, and wherein one of the at least two suction chambers is a lower suction chamber that faces the front guide stop and is connected with the suction belt, the lower suction chamber adapted to be adjustably vented to interrupt the supply of negative pressure to said lower suction chamber within a working cycle leading the last sheet to the front guide stop.

2. The apparatus of claim 1, further comprising a servo unit adapted to control the supply of negative pressure to the lower suction chamber.

3. The apparatus of claim 1, further comprising a servo device and an air-removing flap actuated by the servo device, the lower suction chamber adapted to be vented through the air-removing flap.

4. The apparatus of claim 3, further comprising a control unit and a double-sheet control for detecting the last sheet and transmitting a signal to the control unit when the last sheet is detected, wherein the servo device is operably connected and responsive to the control unit.

5. The apparatus of claim 1, further comprising a double-sheet control to detect the last sheet.

6. The apparatus of claim 5, further comprising a control unit, wherein the double-sheet control is operably connected to the control unit, characterized in that when the last sheet is detected by the double-sheet control, a signal is generated and sent to the control unit.

7. The apparatus of claim 1, wherein the sheet-processing machine comprises means for taking hold of sheets.

8. An apparatus for supplying a shingled or overlapping sheet stream from a stack of sheets of a sheet feeder to a feed table of a sheet-processing machine with a belt table, which is provided with at least one revolvingly driven suction belt in operative connection with at least two suction chambers, which can be acted upon by a supply of negative pressure, said apparatus including a front guide stop and a device for detecting a last sheet in the sheet stream, wherein the at least one revolvingly driven suction belt is adapted to stop operating after the last sheet of the sheet stream is detected by the device for detecting and the front edge of the last sheet has been placed against the front guide stop, and wherein one of the at least two suction chambers is a lower suction chamber that faces the front guide stop and is connected with the suction belt, the lower suction chamber adapted to be adjustably vented to interrupt the supply of negative pressure to said lower suction chamber within a working cycle leading the last sheet to the front guide stop, the apparatus further comprising a control unit and a servo unit operably connected and responsive to the control unit, the servo unit being adapted to control the supply of negative pressure to the lower suction chamber in accordance with the control unit, and a double-sheet control for detecting the last sheet and transmitting a signal to the control unit when the last sheet is detected.

9. An apparatus for supplying a sheet stream including a last sheet to a sheet-processing machine, comprising:

a belt table provided with at least one revolvingly driven suction belt and at least two suction chambers, said at least one revolvingly driven suction belt being in operative connection with said at least two suction chambers, said at least two suction chambers being able to be acted upon by a supply of negative pressure controlled by a servo unit;

a feed table having a front guide stop, said feed table being disposed downstream of said belt table; and a device for detecting said last sheet;

wherein said at least one revolvingly driven suction belt is adapted to stop operation when said last sheet of said sheet stream is detected by said device for detecting said last sheet and a front edge of said last sheet is placed against said front guide stop; and wherein one of said at least two suction chambers is a lower suction chamber, said lower suction chamber facing said front guide stop and being able to be vented, and wherein said supply of negative pressure to said lower suction chamber can be interrupted within a working cycle leading said last sheet to said front guide stop.

10. The apparatus of claim 9, wherein said lower suction chamber can be vented through an air-removing flap, which can be actuated by a servo device.

11. The apparatus of claim 10, wherein said device for detecting said last sheet is a double-sheet control device.

12. The apparatus of claim 11, further comprising:

a control unit for controlling said servo unit; and a device for transmitting a signal to said control unit when said last sheet is detected by said double-sheet control device.

13. The apparatus of claim 12, wherein said control unit can control said servo device.

14. The apparatus of claim 9, wherein one of said at least two suction chambers is an upper suction chamber, which can be supplied with negative pressure, said negative pressure serving as a force for holding the sheets being conveyed on said suction belt.

* * * * *